United States Patent [19]

Becker et al.

[11] 3,965,953

[45] June 29, 1976

[54] FLEXIBLE CONTAINER FOR WINE AND FRUIT-JUICE

[75] Inventors: Theo Becker, Deidesheim; Eduard Hilscher, Idstein, Taunus; Karl-Heinz Ott, Kelkheim, Taunus, all of Germany

[73] Assignee: Hoechst Aktiengesellschaft, Frankfurt am Main, Germany

[22] Filed: Sept. 10, 1974

[21] Appl. No.: 504,701

[30] Foreign Application Priority Data

Sept. 12, 1973 Germany ..... 7332995[U]

[52] U.S. Cl. ..... 150/3; 150/.5; 150/1

[51] Int. Cl.[2] ..... B65D 89/08; B65D 85/72; B65D 33/06; B65D 33/24

[58] Field of Search ..... 150/.5, 1, 3; 24/205 R, 24/205.1 R

[56] References Cited

UNITED STATES PATENTS

| | | | |
|---|---|---|---|
| 1,876,338 | 9/1932 | Norton | 24/205.1 R |
| 2,123,454 | 7/1938 | Doppelt | 24/205 R |
| 2,344,861 | 3/1944 | Fowler | 24/205 R |
| 2,495,114 | 1/1950 | Leguillon | 24/205.1 R |
| 2,674,289 | 4/1954 | Silverman | 24/205.1 R |
| 2,701,222 | 2/1955 | Hetzel | 24/205 R |
| 2,962,070 | 11/1960 | Towles | 24/205.1 R |
| 3,162,917 | 12/1964 | Bair | 24/205.1 R |
| 3,417,406 | 12/1968 | Rosenbaum | 24/205 R |

*Primary Examiner*—Ro. E. Hart
*Attorney, Agent, or Firm*—Curtis, Morris & Safford

[57] ABSTRACT

The opening in a flexible container for wine and fruit-juice of a rubber-lined or coated synthetic fabric is closed by a gas- and liquidtight zipper. An easy and unproblematic cleaning of the container is possible due to the easy opening and closing of the zipper.

8 Claims, 1 Drawing Figure

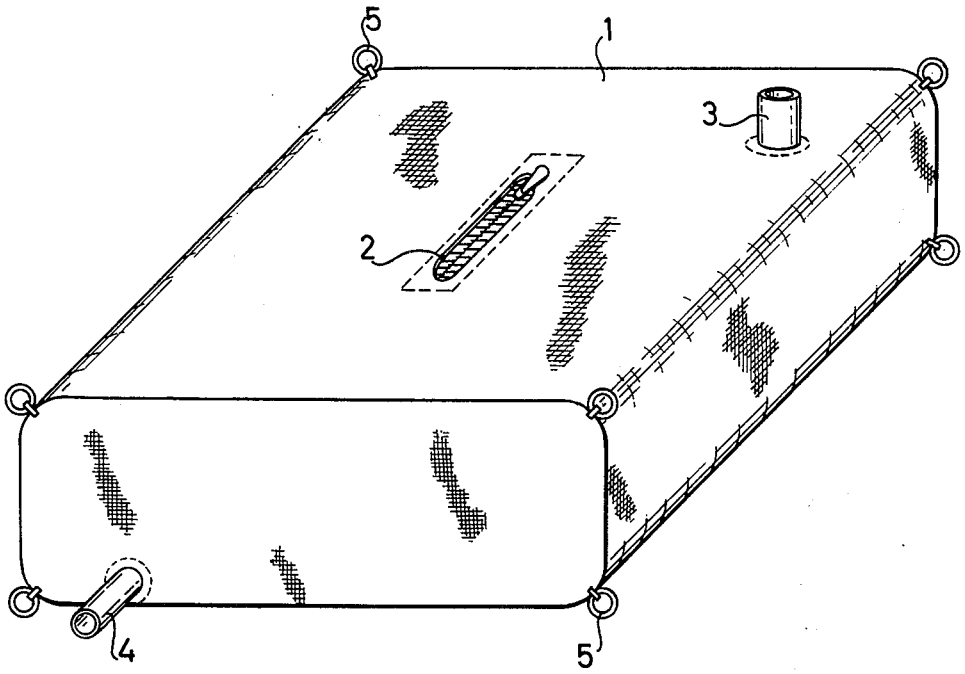
5
1
3
2
4
5

FLEXIBLE CONTAINER FOR WINE AND FRUIT-JUICE

The object of the invention is a flexible container for wine and fruit-juice.

Casks of wood have been used for a long time in the viticulture. More recently, containers of stainless steel and glass fiber reinforced plastics for the storage and transport of wine and fruit-juice have also been used. Futhermore flexible containers of rubber-lined or coated synthetic fabrics resistent to food, for example, those of-rubber lined or coated polyester fabrics have already been tested.

The flexible containers are provided with the fittings of stainless steel including the bunghole, recommended for winecellars and the fruit-juice industry. The bunghole serves for cleaning, and in the case of big casks or containers for walking into and cleaning the inside. In the case of flexible containers the wall of the containers is turned inside out in order to be cleaned and inspected.

The bunghole covering hitherto used for flexible containers with a bunghole was rather heavy and complicated as to its fitting into the wall of the container. It was therefore desirable to provide an adequate flexible container with a lighter sealng, which can be fitted and handled more easily.

The object of the present invention is, consequently, a flexible container for wine and fruit-juice of a rubber-lined or coated synthetic fabric resistant to food (polyester, polyamide and especially polyethylene terephthalate) provided with an opening big enough for cleaning the inside of the container, wherein the opening is provided with a known gas- and liquidtight zipper, by which the container can be closed or opened, if required, so as to be gas- and liquidtight. The gas- and liquidtight zipper inserted into the container wall (for example by welding of bonding) should have a length of at least about 50 cm. This length is generally sufficient for turning the wall of the container easily inside out and for cleaning it.

The flexible container for wine and fruit-juice has the advantage over known flexibe containers provided with the usual bunghole and bunghole covering in that it can be opened and closed more easily and consequently can be cleaned more easily.

The FIGURE of the drawing illustrates a perspective view of the flexible container of the present invention.

The invention is illustrated diagrammetically by way of example in the accompanying drawing, which is a perspective view of the flexible container according to the invention. The gas- and liquidtight zipper 2 is inserted into the container 1 having a volume of 1 $m^3$. A filling device 3 and an emptying device 4 serve for filling and emptying the container and the corners are provided with loops 5 for an easier handling, for example, when transporting it.

The present invention, of course, includes other sizes and forms of the container, which are not shown in the drawing.

What is claimed is:

1. A flxible gas and liquidtight container for wine and/or fruit-juice, lined with a material resistent to wine and/or fruit-juice, having four sides, a top and a bottom forming four corners, a filling opening, an emptying opening and an opening big enough for cleaning the inside of the container, said cleaning opening having a gas and liquidtight zipper by which the cleaning opening can be opened and closed and each of said corners being provided with means for ease of handling and transporting said container.

2. The container of claim 1 in which the zipper has a length of at least 50 cm.

3. The container of claim 1 in which the zipper has a length of about 50 cm.

4. The container of claim 1 having a volume of about 1 $m^3$.

5. The container of claim 1 having a volume of about 1 $m^3$ and a zipper which has a length of about 50 cm.

6. The container of claim 1 lined with a rubber or a synthetic fabric resistant to wine and/or fruit-juice.

7. The container of claim 1 wherein the wine and fruit-juice resistant liner material is a member selected from the group consisting of rubber, polyester, polyamide and polyethylene terephathalate.

8. The container of claim 1 wherein each of said corners is provided with a loop as the means for ease of handling said container.

* * * * *